US010371046B2

(12) United States Patent
Yan et al.

(10) Patent No.: US 10,371,046 B2
(45) Date of Patent: Aug. 6, 2019

(54) MOVABLE FULCRUM FOR DIFFERENTIAL AND VARIABLE-STROKE CYCLE ENGINES

(71) Applicant: YAN ENGINES, LTD, Brighton (GB)

(72) Inventors: Hailuat D. Yan, Austin, TX (US); Ming Jeng Yan, Austin, TX (US)

(73) Assignee: Yan Engines, Ltd., Hove (GB)

( * ) Notice: Subject to any disclaimer, the term of this patent is extended or adjusted under 35 U.S.C. 154(b) by 0 days.

(21) Appl. No.: 16/088,516

(22) PCT Filed: Mar. 30, 2017

(86) PCT No.: PCT/GB2017/050894
§ 371 (c)(1),
(2) Date: Sep. 26, 2018

(87) PCT Pub. No.: WO2017/168157
PCT Pub. Date: Oct. 5, 2017

(65) Prior Publication Data

US 2019/0112976 A1 Apr. 18, 2019

(30) Foreign Application Priority Data

Apr. 1, 2016 (GB) ..... 1605579.0

(51) Int. Cl.
*F02B 75/00* (2006.01)
*F02B 75/04* (2006.01)
*F02D 15/02* (2006.01)

(52) U.S. Cl.
CPC ..... *F02B 75/045* (2013.01); *F02D 15/02* (2013.01)

(58) Field of Classification Search
CPC ..... F02B 75/045; F02D 15/02
See application file for complete search history.

(56) References Cited

U.S. PATENT DOCUMENTS

| | | | | |
|---|---|---|---|---|
| 1,220,095 | A | 3/1917 | Gray | |
| 5,243,938 | A | 9/1993 | Yon | |
| 2002/0026910 | A1* | 3/2002 | Hiyoshi | F02B 75/045 123/48 B |
| 2013/0312703 | A1 | 11/2013 | Yon | |
| 2014/0366847 | A1 | 12/2014 | Yan et al. | |
| 2015/0219022 | A1* | 8/2015 | Nagai | F02B 75/045 123/48 B |
| 2018/0245508 | A1* | 8/2018 | Tomoda | F01B 31/14 |

FOREIGN PATENT DOCUMENTS

EP 2995800 A1 3/2016

* cited by examiner

*Primary Examiner* — Thomas N Moulis
(74) *Attorney, Agent, or Firm* — Lloyd L. Davis; Hunton Andrews Kurth, LLP

(57) ABSTRACT

An engine includes an engine shaft configured to rotate and cause one or more pistons to reciprocate within a cylinder chamber along an axis, each piston having a first piston part and piston stem to move in unison with or separately from a second piston part to define piston strokes for different thermal functions of the engine. The engine further includes a piston lever having a first end coupled to a movable fulcrum point and a second end coupled at a copy point to the piston stem, an actuation mechanism configured to move the piston lever and thereby the copy point, and a guide apparatus configured to dictate movement of the copy point in a direction substantially parallel to the cylinder axis.

12 Claims, 5 Drawing Sheets

MOVABLE FULCRUM FOR DIFFERENTIAL AND VARIABLE-STROKE CYCLE ENGINES

FIELD

Embodiments disclosed herein relate to internal combustion engines, and in particular, piston internal combustion engines. More particularly, embodiments disclosed herein relate to a movable fulcrum for differential and variable-stroke cycle internal combustion engines.

BACKGROUND AND SUMMARY

The internal combustion engine is an engine where the combustion of a fuel occurs with an oxidizer in a combustion chamber that is an integral part of the working fluid flow circuit. In an internal combustion engine the expansion of the high-temperature and high-pressure gases produced by combustion apply direct force to some component of the engine, typically a piston. This force moves the component over a distance, transforming chemical energy into useful mechanical energy.

In one aspect, embodiments disclosed herein relate to an engine having an engine shaft configured to rotate and cause one or more pistons to reciprocate within a cylinder chamber along an axis, each piston having a first piston part and piston stem to move in unison with or separately from a second piston part to define piston strokes for different thermal functions of the engine. The engine further includes a piston lever having a first end coupled to a movable fulcrum point and a second end coupled at a copy point to the piston stem, an actuation mechanism configured to move the piston lever and thereby the copy point, and a guide apparatus configured to dictate movement of the copy point in a direction substantially parallel to the cylinder axis.

DETAILED DESCRIPTION

Figure 1:
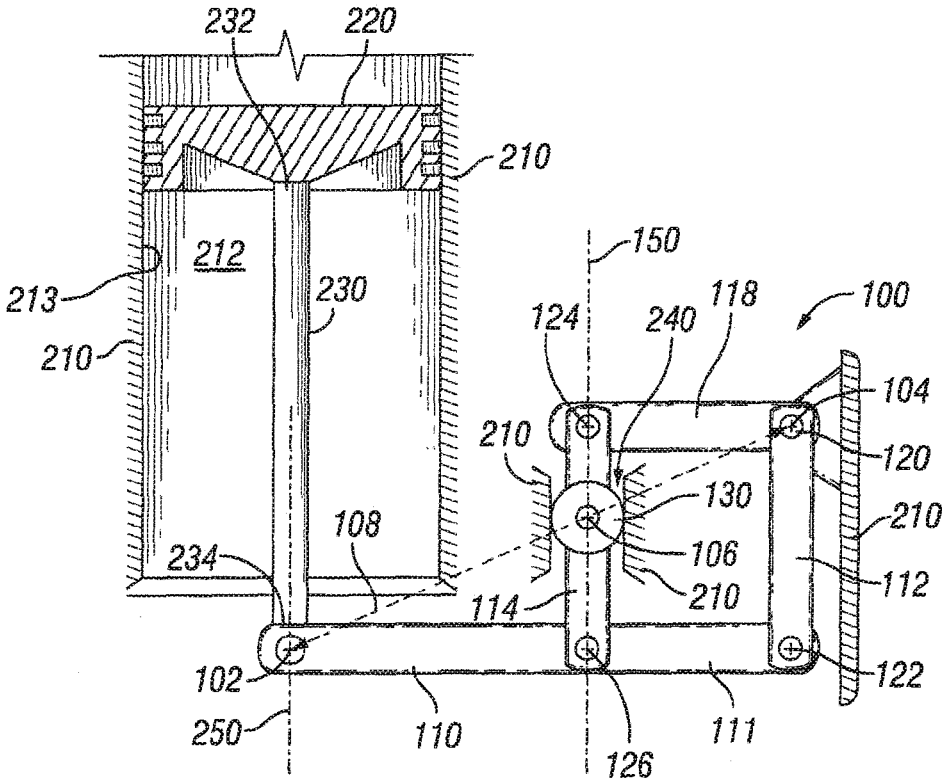
FIG. 1 illustrates a section view of an embodiment of a piston-train guide assembly.

The aspects, features, and advantages of one or more embodiments mentioned herein are described in more detail by reference to the drawings, wherein like reference numerals represent like elements. Embodiments disclosed herein provide an assembly and guide, or guided assembly, incorporated within a piston-train of a differential or variable stroke internal combustion engine, which may be incorporated separately or in a single apparatus. In certain embodiments, the assembly may be referred to as a robotic arm assembly. In other embodiments, the assembly may be referred to as an actuator assembly. The robotic assembly may be attached to an engine block or other location at one end with an arm-like lever apparatus extended toward the cylinder axis to move the piston stem of a piston part (e.g., a first or inner piston part) in a substantially linear lengthwise motion along the cylinder axis.

It may be beneficial when the combinations of the four engine strokes, in displacements and periods, are continuously optimized real-time during engine operations for fuel efficiency, power, and emission. For such purposes, a robotic optimization device, controlled by an engine's electronic control unit, having a robotic arm extending into the cylinder axis acting directly on the piston stem may be utilized. The robotic arm device may be coupled to the piston stem to operate the first piston part. The robotic device may be located away from the cylinder chamber and from the moving parts of the piston kit. The robotic arm device may be configured to perform multi-dimensional motions to maintain a linear lengthwise motion of the piston stem and first piston part along the cylinder axis. In certain embodiments, a linear robotic device, or a linear actuator apparatus, acting on the piston lever is provided to maintain a linear lengthwise motion of the piston stem and first piston part along the cylinder axis.

Referring to FIG. 1, a schematic view of a piston-train guide assembly in accordance with one or more embodiments of the present disclosure is shown. The piston-train guide apparatus 100 (or assembly) may be incorporated within the piston-train in the differential stroke internal combustion engine illustrated in FIG. 2. As used herein, a "piston-train" may include a piston, piston lever-link-bar and guide assembly coupled together as an assembly and operable within the engine. The guide assembly may also be referred to herein as a control and guide apparatus or a control and linkage assembly.

The differential stroke internal combustion engine typically includes an engine block 210 having one or more cylinder bores 212, and an inner or first piston part 220 located within each of the one or more cylinder bores 212. The inner piston part 220 may be in sliding contact (or abutting) engagement with a respective cylinder bore wall 213. A piston stem 230 is coupled at a first end 232 to the inner piston part 220, and is hingedly (or pivotally) coupled at a second end 234 to a piston lever-link-bar 110. The hinged coupling (pivotal junction) may define a 'copy' point 102, described in greater detail below.

The guide apparatus 100 defines and includes a linkage assembly (e.g., a four-bar-linkage) including a portion 111 of the piston lever-link-bar 110, a fulcrum-link bar 112, a force-link bar 114, and a rocker-link bar 118. In defining and locating the four-bar-linkage, the guide apparatus 100 may be hingedly coupled to the engine block 210 at a first hinge junction 120 of a first end of the fulcrum-link bar 112 and a first end of the rocker-link bar 118. The hinged coupling (pivotal junction) defines an 'anchor' (or attachment) point 104, described in greater detail below. The four-bar-linkage further includes a second hinge junction 122 of a second end of the fulcrum-link bar 112 and a first end of the portion 111 of the piston lever-link-bar 110, a third hinge junction 124 of a second end of the rocker-link bar 118 and a first end of the force-link bar 114, and a fourth hinge junction 126 of a second end of the force-link bar 114 and a second end of the portion 111 of the piston lever-link-bar 110.

A guide element or guide roller 130 is coupled (for example rotatably or pivotally) to the force-link bar 114 at an 'origin' point (or axis) 106. The 'origin' point 106 is located at the intersection between the force-link bar 114 and an imaginary line—indicated by line 108—defined between the 'copy' point 102 and the 'anchor' point 104. The guide roller 130 may be in sliding or rolling contact with a guide apparatus 240. In certain embodiments, the guide apparatus 240 may be integrally formed as a structure within and defined by the engine block 210. For example, the guide apparatus may be formed as a channel, groove, or other structure within the engine. In other embodiments, the guide apparatus 240 may be rigidly attached or fastened to the engine block 210. As shown, in certain embodiments, the guide apparatus 240 may be linear or substantially linear. The guide roller 130 moves within the guide apparatus 240 such that the guide roller 130 and 'origin' point 106 move along a guide axis 150 of the guide apparatus 240 that is parallel to the cylinder axis 250 of cylinder 212. In certain embodiments, the guide element may include a spring element (not shown) of any type coupled to the linkage assembly to centrally bias and control the copy point substantially along the cylinder chamber axis.

The four-bar-linkage of the guide apparatus 100 may be configured to form a pantographic assembly or apparatus. It will be understood by those skilled in the art that a pantographic assembly may be formed from mechanical linkages connected in a manner based on parallelograms, such that movement of one point of the assembly (for example, the 'origin' point 106) produces respective (and possibly scaled) movements in a second point of the assembly (for example, the 'copy' point 102).

In certain embodiments, the scaled movement of the 'copy' point 102 is restrained along the cylinder axis 250 by the movement of the 'origin' point 106 along the guide axis 150. This pantographic assembly of the four-bar-linkage, which effectively translates motion in a controlled fashion, is used as a motion guide for the 'copy' point 102. Accordingly, in certain embodiments, the four-bar-linkage defines a pantographic device that guides the piston lever-link-bar 110 to move at the pivotal junction with the piston stem 230 (i.e., the 'copy' point 102) in a straight line motion lengthwise along the cylinder axis 250. In other words, as the origin point 106 travels along guide axis 150 of the linear guide 240, the copy point 102 travels in a lengthwise linear motion along cylinder axis 250 of the cylinder 212.

It will be appreciated that other guide elements or devices may also be incorporated with the four-bar-linkage of the guide apparatus 100 at locations that have a functional relationship with the linear motion of the copy point 102. As one example, a guide element or guide roller may be located on the piston lever-link-bar 110 at the junction 126 with the force-link bar 114. In this example, a curved or non-linear guide channel may guide lateral motion of the piston lever-link-bar 110, such that the pivotal junction 102 between the piston lever-link-bar 110 and the piston stem 230 makes linear lengthwise motions aligned with the cylinder axis 250 as the piston lever-link-bar 110 is oscillated to actuate and stroke the inner piston part 220.

In certain embodiments, a functional relationship exists between a particular location on the linkage assembly and the copy point 102. For example, the functional relationship may comprise moving a particular location on the linkage assembly, and consequently moving the copy point 102 accordingly. Further still, the functional relationship may comprise moving a particular location on the linkage assembly, in either a linear or non-linear fashion, and consequently moving the copy point 102 in a linear fashion. In certain embodiments, the particular location on the linkage assembly may comprise the origin point 106. Accordingly, the guide element or guide roller 130 may be incorporated with the four-bar-linkage at certain locations to provide linear motion to the copy point 102, as will be understood by those skilled in the art.

In certain embodiments, a spring device (not shown) located or attached at any location on the piston-train may be included. For example, the spring device may be proximal to the hinge junction 122 (of a second end of the fulcrum-link bar 112 and a first end of the portion 111 of the piston lever-link-bar 110) may restrict or guide lateral movement of the piston lever-link-bar 110. Lateral movement is defined as movement not substantially aligned with the cylinder axis 250. The spring may be any type of spring device as will be understood by one of ordinary skill in the art. Further, the spring may be anchored at one end to the engine block and the other end to the piston-train. Alternatively, the spring may be anchored to only the engine block. The spring may be biased to restrict or reduce lateral movement of the fulcrum-link bar 112 such that the piston stem 230 stays within a tolerance limit substantially aligned with the cylinder axis 250.

Figure 2:
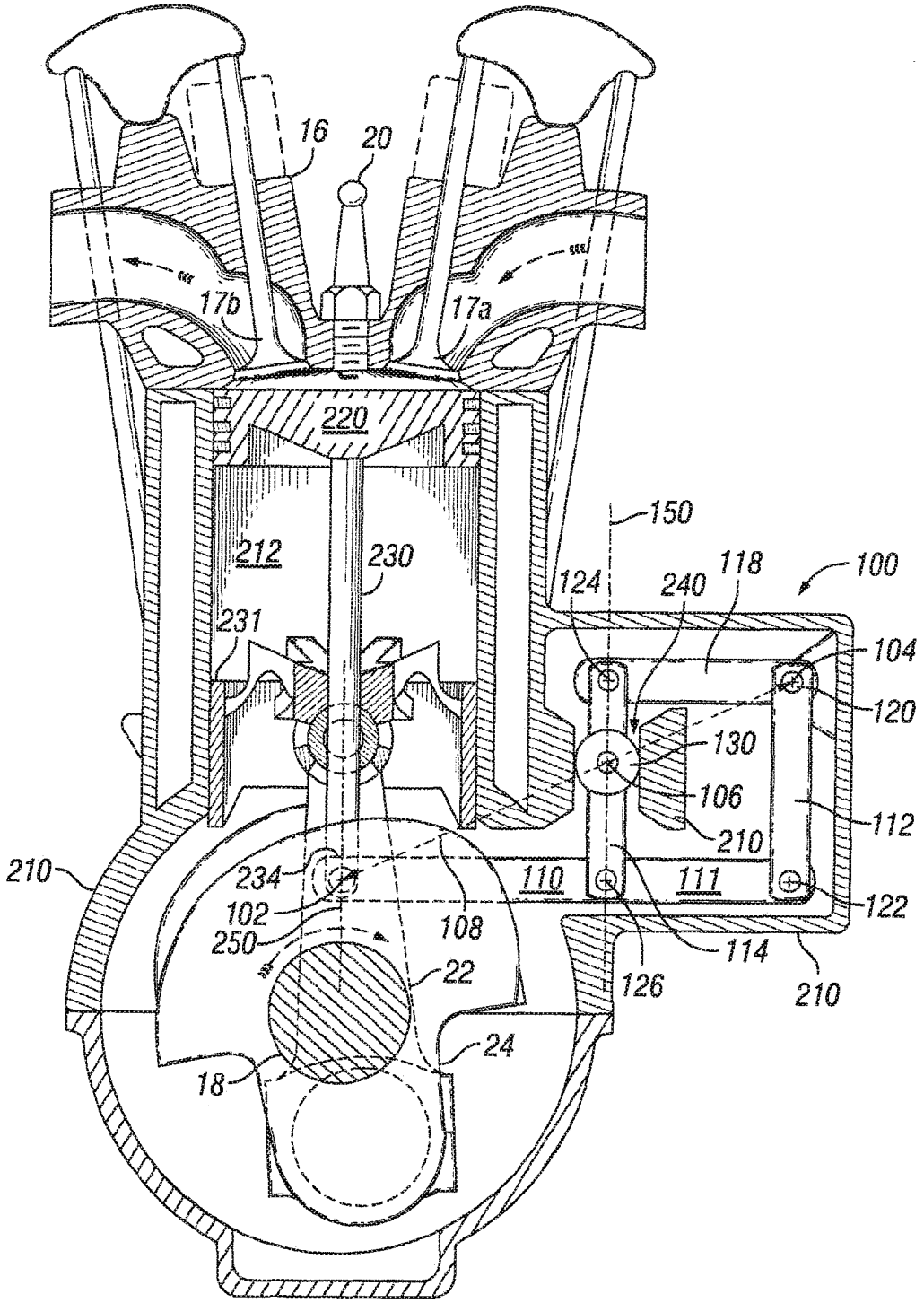
FIG. 2 illustrates a section view normal to the axis of rotation of the crankshaft of an embodiment of an engine having the piston-train guide assembly of FIG. 1.

Referring to FIG. 2, a cross-section view normal to the axis of rotation of the crankshaft of a differential stroke engine having a control and guide apparatus 100 incorporated therein in accordance with one or more embodiments of the present disclosure is shown. A differential stroke piston moves within the fixed cylinder 212 between a fixed cylinder head 16 above and a rotating crankshaft 18 below, referring to the orientation of the engine shown in FIG. 2. Charging and exhausting cylinder 212 is controlled by intake valve 17*a* and exhaust valve 17*b* respectively. Combustion is initiated by a spark plug 20 (not used in diesel applications) in cylinder head 16. Engine 210 is operable to complete one full combustion cycle per engine revolution.

The differential stroke piston has an inner piston part 220 which closes and seals the combustion chamber and an outer piston part 231 which is connected by a connecting rod 22 to the crankshaft 18 and also serves as a carrier for the inner piston part 220 during portions of its cycle. Embodiments disclosed herein provide for the inner piston part 220 to operate on four strokes per cycle and the outer piston part 231 to operate on two strokes per cycle. During the exhaust and the intake portions of the cycle, the inner piston part 220 and outer piston part 231 separate. During separation, inner piston part 220 is actuated and driven by the control and guide apparatus 100 described in FIG. 1. As shown, in certain embodiments, the guide apparatus 100 may be located outside of the cylinder and cylinder bore 212 and positioned away from the movements of the piston parts and engine shaft. Meanwhile, the outer piston part 231 continues to move under control of crank arm 24 and connecting rod 22.

In certain embodiments, an actuator (e.g., a robotic arm device) operable independent of the engine shaft (e.g., crankshaft) may be provided to define or optimize the piston strokes during different thermal functions of the engine and adapt the optimal piston stroke combinations to changing loading conditions during engine operations. The actuator may be synchronized with other engine components, such as an associated electronic or mechanical cam-less valve train, e.g., a valve train system that has no cams and is operated by electronics. The actuator and other engine components may be controlled and optimized by an engine electronic control unit. In other embodiments, the actuator may be a linear actuator. In certain embodiments, the actuator may comprise an electromechanical actuator, or any device which carries out electrical operations by using moving parts, or actuator tongue that moves in a substantially linear direction. The electromechanical actuator may be controlled by an engine electronic control unit. In other embodiments, the actuator may be controlled by hydraulic, mechanical, or electromechanical systems or components.

In one embodiment, a guide element on the piston lever is provided that travels within a curved guide and guides the lever motion at the piston stem junction to be linear along the cylinder axis as the lever swings about a fulcrum. In another embodiment, a linear robotic device is provided that acts on the lever using the pantographic principle. The motion of the piston lever or robotic arm at the piston stem junction is linear lengthwise along the cylinder axis, while motion away from the cylinder axis is two dimensional both parallel and perpendicular to the cylinder axis.

Figure 3:
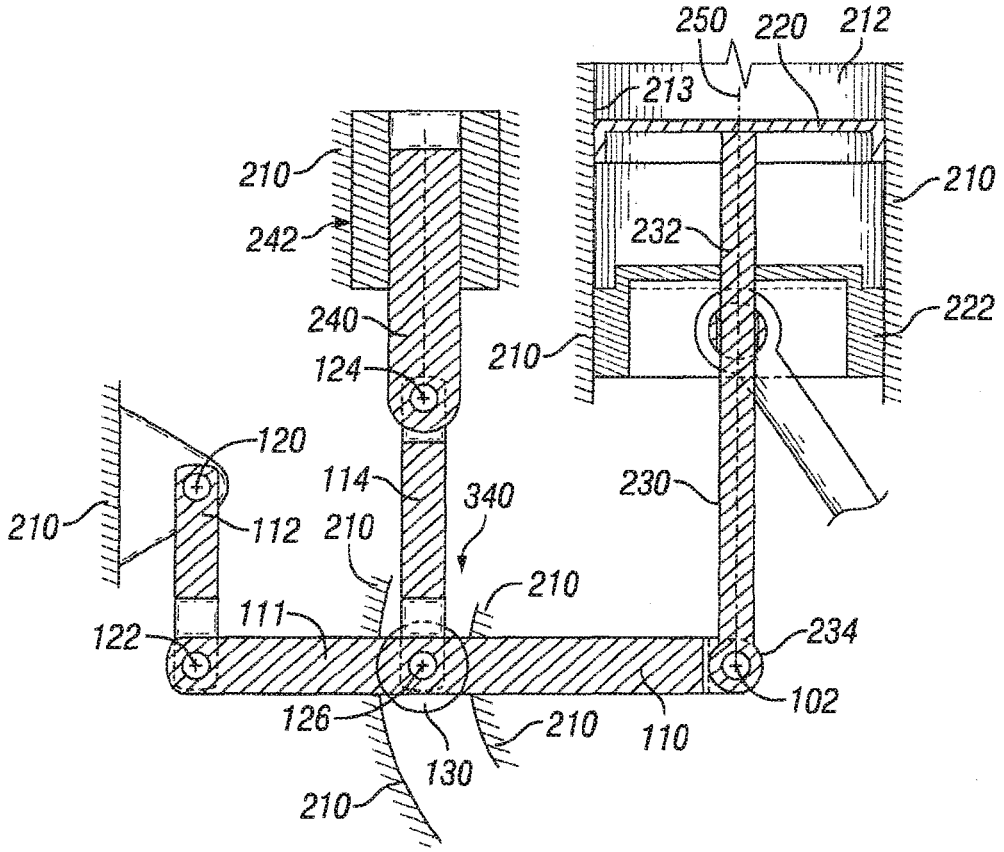
FIG. 3 illustrates a section view of an embodiment of a curved-guide linear actuator mechanism.

FIG. 3 illustrates an embodiment of a curve-guided linear actuator mechanism. Two-part piston having a first piston part 220 and second piston part 222 is shown. A linkage assembly defines a three-bar-linkage including a piston lever-link-bar 111, a fulcrum-link bar 112, and a force-link bar 114. Three-bar-linkage is defined and located by a first hinge junction 120 (e.g., an anchor point) pivotally coupled to the engine block 210 and connecting a first end of the fulcrum-link bar 112, a second hinge junction 122 connecting a second end of the fulcrum-link bar 112 and a first end of the piston lever-link-bar 111, a third hinge junction 124 connecting a linear actuator 240 and a first end of the force-link bar 114, and a fourth hinge junction 126 connecting a second end of the force-link bar 114 and a location on the piston lever-link-bar 111. A linear actuator tongue 240 (housed in the actuator apparatus 242) may be pivotally attached to the force link bar 114 via pin 124. A guide element 130 is disposed within a curved guide device 340 formed integrally with or fastened to the engine block 210. The guide element 130 may be coupled at pin 126.

As the first piston part 220 makes the linear lengthwise motion in the cylinder 212, the fulcrum-link bar 112 swings in an arc around the pivot attachment 120 on the engine block 210 toward and away from the cylinder axis 250. The force-link bar 114 and guide element 130 move in multiple dimensions (e.g., curved) to compensate for the piston lever motion. In this fashion, the linear actuator tongue 240 may control the motion of the lever 110 to define substantially linear movement of the copy point 102 along the cylinder axis 250. A relationship between curved motion of the guide element 130 and linear motion of the copy point 102 may be correlated and calculated with a computer or engine electronic control unit. The axis of the linear actuator need not be parallel to the cylinder axis 250.

Figure 4:
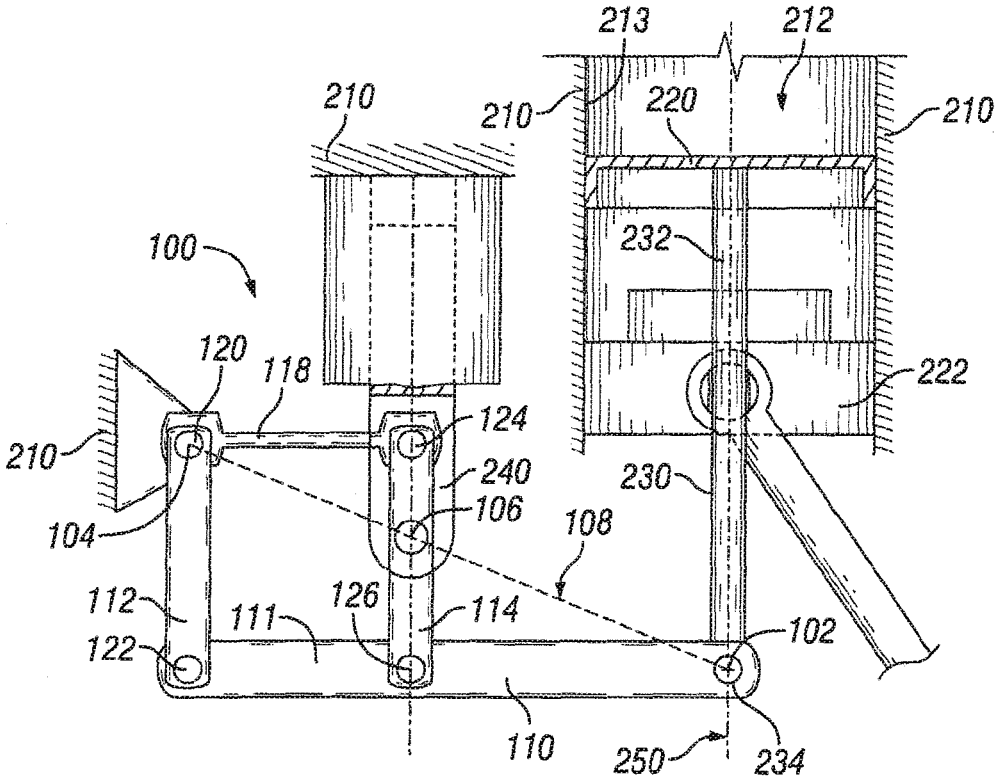
FIGS. 4 and 5 illustrate section views of an embodiment of a pantographic-guide linear actuator mechanism.
Figure 5:
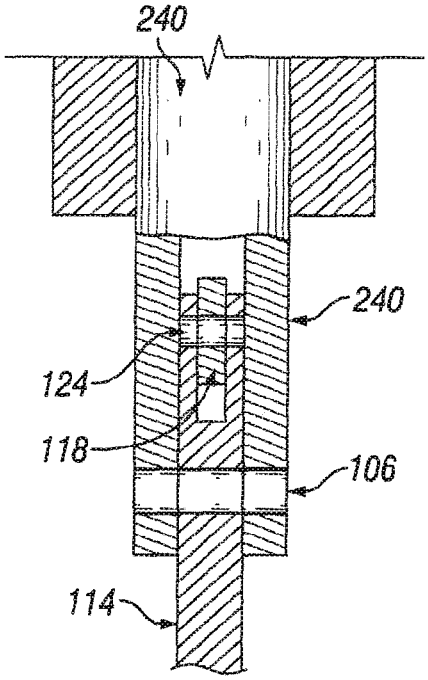

FIGS. 4 and 5 illustrate an embodiment of a linear relationship implemented via a pantographic guided linear actuator mechanism. The pantograph includes a 4-bar-linkage of linkage bars 111, 112, 114, and 118 with a lever bar which consist of one of the linkage bar 111 and its extension 110. The force-linkage-bar 114 may have two sections divided by its junction with the linear actuator at 106. The applied force between the joint 106 and 126 may be greater than that between 106 and 124. The more lightly loaded section 106 to 124 may be built into a linear actuator tongue 240. The linkage-bar 118 may be equally light-loaded, and configured to provide a guiding function, and may be made similarly thinner to fit into the actuator tongue. The linear actuator tongue 240 may be attached to the force-linkage bar at the origin point 106 of the pantograph. The functional relationship between linear motions of the robotic actuator and the desired motions of the inner piston 220 strokes may be determined by multiplying by a constant. The axis of linear actuator tongue 240 may be parallel to that of the cylinder axis 250.

Figure 6:
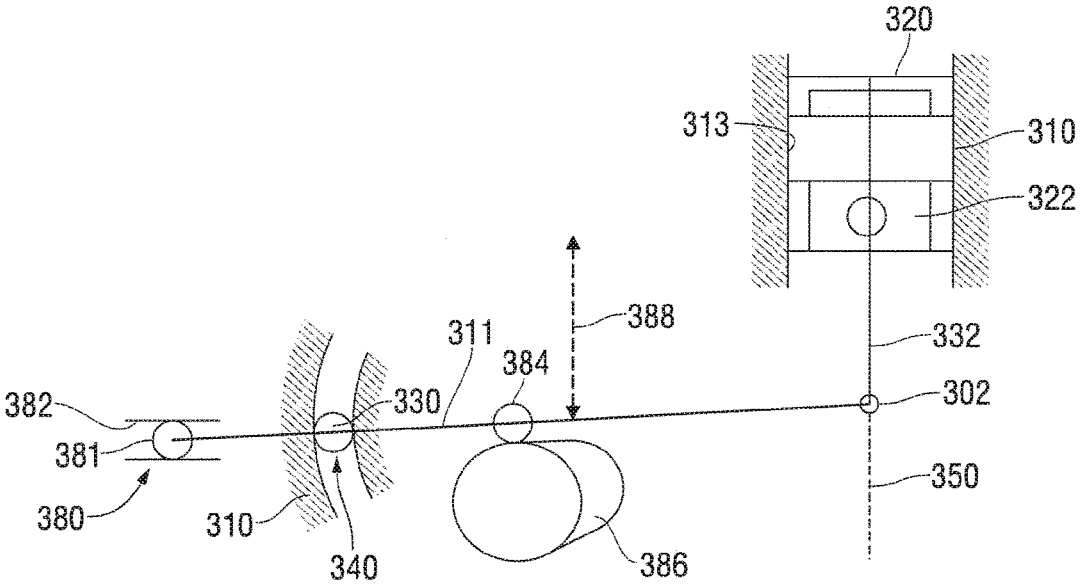
FIG. 6 illustrates a schematic view of an embodiment of a movable fulcrum for a variable-stroke internal combustion engine.

FIG. 6 illustrates a schematic view of an embodiment of a movable fulcrum for a variable-stroke internal combustion engine having a two-part piston with first or upper piston part 320 and second or lower piston part 322. A piston lever 311 is coupled at a first end to a movable fulcrum point 380 and at a second end to the first piston part 320 by way of the piston stem 332 at a copy point 302. The movable fulcrum includes a roller 381 configured to move within a guide apparatus 382. In one example, the guide apparatus 382 may be a guide channel having opposing walls between which the roller 381 is disposed. The roller 381 may engage the guide channel walls and roll or slide as it moves within the guide channel. The movable fulcrum point 380 may be configured to move in any direction. Preferably, the movable fulcrum point 380 may move in a direction substantially perpendicular to the cylinder axis 350.

An actuation mechanism is configured to operate the piston lever 311 and thereby define substantially linear movement of the copy point 302 along the cylinder axis 350. The actuation mechanism may be coupled to the piston lever 311 at any location along its length. In one embodiment, the actuation mechanism comprises a cam follower 384 coupled to the piston lever 311, wherein the cam follower 384 is configured to engage and run on a mating cam profile 386 to operate the piston lever 311. The actuation mechanism may also comprise an electromechanical actuator operable independently of the engine shaft, or the actuation device may comprise a hydraulic actuator. In other embodiments, other actuation mechanisms may be used including means controlled electronically during engine operation such as electro-mechanic, electromagnetic, hydraulic, pneumatic or devices controlled via electronic circuit or solenoid. A return mechanism 388 may comprise a spring device configured to bias the piston lever 311 in a direction substantially opposite the mating engagement between the cam follower 384 and the engine cam profile 386. In another embodiment, the return mechanism comprises a second cam follower coupled to the piston lever, wherein the second cam follower is configured to engage and run on a second mating cam profile.

A guide apparatus 340 is configured to dictate the movement of the piston lever 311 at the copy point 302 in a direction substantially parallel to the cylinder axis 350. The guide apparatus 340 may be coupled to the piston lever 311 at any location along its length. The guide apparatus 340 may include a guide element 330 coupled to the piston lever 311 configured to dictate movement of the piston lever 311. The guide element 330 may include a bearing 330 coupled to the piston lever 311, wherein the bearing is configured to engage and travel within a guide channel 310. The guide channel 310 may be curved or contoured.

In certain embodiments, a variable-stroke reciprocating internal combustion engine, the engine having an engine shaft and a piston configured to reciprocate within a cylinder chamber having an axis, each piston having a first piston part operable to move in unison with or separately from a second piston part to define piston strokes for different thermal functions of the engine, includes an assembly pivotally coupled to the first piston part at a copy point and an actuator coupled to the assembly. The actuator is operable to control motion of the assembly to thereby define substantially linear movement of the copy point along the cylinder chamber axis. The assembly may be coupled to the engine at an anchor point. The actuator may comprise a linear actuator. The assembly comprises a four-bar-linkage including a piston lever-link-bar, a fulcrum-link bar, a force-link bar, and a rocker-link bar. The four-bar-linkage is defined and located by a first hinge junction pivotally coupled to the engine and connecting a first end of the fulcrum-link bar and a first end of the rocker-link bar, a second hinge junction connecting a second end of the fulcrum-link bar and a first end of the piston lever-link-bar, a third hinge junction connecting a second end of the rocker-link bar and a first end of the force-link bar, and a fourth hinge junction connecting a second end of the force-link bar and a location on the piston lever-link-bar. The four-bar linkage defines a parallelogram forming a pantograph, and the coupling between the actuator and linkage is located along a line defined between the copy point and the anchor point.

Or, the assembly defines a three-bar-linkage including a piston lever-link-bar, a fulcrum-link bar, and a force-link bar. The three-bar-linkage is defined and located by a first hinge junction pivotally coupled to the engine and connecting a first end of the fulcrum-link bar, a second hinge junction connecting a second end of the fulcrum-link bar and a first end of the piston lever-link-bar, a third hinge junction connecting the linear actuator and a first end of the force-link bar, and a fourth hinge junction connecting a second end of the force-link bar and a location on the piston lever-link-bar. A guide element is movable within a curved guide defined within the engine and coupled with the three-bar linkage, wherein the guide element moves in an arc as the first piston part makes a linear lengthwise motion in the cylinder. The actuator comprises an electromechanical actuator operable independently of the engine shaft. An electronic engine control unit is used for operating the electromechanical actuator.

A method of operating a variable-stroke reciprocating internal combustion engine, the engine having an engine shaft and a piston configured to reciprocate within a cylinder chamber having an axis, each piston having a first piston part operable to move in unison with or separately from a second piston part to define piston strokes for different thermal functions of the engine, includes providing an assembly pivotally coupled to the first piston part at a copy point, and an actuator coupled to the assembly and operating the actuator to control motion of the assembly and thereby define substantially linear movement of the copy point along the cylinder chamber axis. The method further comprises operating an electromechanical actuator. The method further comprises operating the actuator by an electronic engine control unit. The method further comprises operating the actuator in a substantially linear direction. The method further comprises operating the assembly independently of the engine shaft.

The method further comprises providing a guide element movable within a curved guide defined within the engine and coupled with the assembly at a first location having a functional relationship with the copy point. The method further comprises moving the guide element in multiple dimensions within the curved guide and accordingly, moving the first piston part within the cylinder substantially along the cylinder axis. The method further comprises defining a pantograph apparatus in the assembly, wherein the pantograph apparatus defines a one-to-one scaled relationship between an origin point and the copy point, activating the linear actuator and moving the origin point a first linear distance, and moving the copy point a second linear distance, wherein the second linear distance is a scaled amount relative to the first linear distance. The method further comprises operating the pantograph apparatus comprising a four-bar-linkage including a piston lever-link-bar, a fulcrum-link bar, a force-link bar, and a rocker-link bar.

Advantageously, embodiments disclosed herein provide a control and guide apparatus in which motion of the inner piston portion is guided at the chamber inner end by the piston crown sliding along the cylinder wall and at the piston stem outer end by the guide apparatus to move substantially along the cylinder axis. Because of the guide apparatus, and particularly the guide element movable within and along an axis of a guide channel, the inner piston part may move up and down with substantially no lateral movement of the piston stem and substantially little lateral thrust against the piston stem from the piston lever-link-bar. Accordingly, stresses and wear of the inner piston portion and on the cylinder wall induced by the piston sideways motions may be reduced. The guide apparatus may also reduce the sliding friction and 'slapping' of the inner piston portion against the cylinder wall.

Moreover, the four-bar-linkage assembly requires relatively little space (as shown in FIG. 2) within the engine itself. Still further, the four-bar-linkage, acting as a pantographic assembly, is capable of moving the piston stem and inner piston part an amount much larger than the amount required to move the guide element within the guide channel.

Reference throughout this specification to "one embodiment" or "an embodiment" or "certain embodiments" means that a particular feature, structure or characteristic described in connection with the embodiment is included in at least one embodiment of the present disclosure. Therefore, appearances of the phrases "in one embodiment" or "in an embodiment" or "in certain embodiments" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Therefore, the term comprising, when used in the claims, should not be interpreted as being limitative to the means or elements or steps listed thereafter. Any one of the terms including or which includes or that includes as used herein is also an open term that also means including at least the elements/features that follow the term, but not excluding others. Accordingly, including is synonymous with and means comprising.

It should be understood that the term "coupled," when used in the claims, should not be interpreted as being limitative to direct connections only. "Coupled" may mean that two or more elements are either in direct physical, or that two or more elements are not in direct contact with each other but yet still cooperate or interact with each other.

Although one or more embodiments of the present disclosure have been described in detail, it will be apparent to those skilled in the art that many embodiments taking a variety of specific forms and reflecting changes, substitutions and alterations may be made without departing from the scope of the invention as set out in the claims. The described embodiments illustrate the scope of the claims but do not restrict the scope of the claims.

The invention claimed is:

1. An engine having an engine shaft configured to rotate and cause one or more pistons to reciprocate within a cylinder chamber along an axis, each piston having a first piston part and piston stem to move in unison with or separately from a second piston part to define piston strokes for different thermal functions of the engine, the engine comprising:

a piston lever having a first end coupled to a movable fulcrum point and a second end coupled at a copy point to the piston stem;

an actuation mechanism configured to move the piston lever and thereby the copy point; and a guide apparatus configured to dictate movement of the copy point in a direction substantially parallel to the cylinder axis, wherein the movable fulcrum comprises a roller or a slider moveable within the guide apparatus such that the movable fulcrum point is configured to move in a direction substantially perpendicular with the cylinder axis.

2. The engine of claim 1, wherein the actuation mechanism comprises a cam follower, coupled to the piston lever, configured to engage and travel on a mating engine cam profile to operate the piston lever.

3. The engine of claim 2, further comprising a return mechanism configured to bias the piston lever in a direction substantially opposite the mating engagement between the cam follower and the engine cam profile.

4. The engine of claim 3, wherein the return mechanism comprises a second cam follower coupled to the piston lever, wherein the second cam follower is configured to engage and run on a second mating engine cam profile.

5. The engine of claim 3, wherein the return mechanism comprises a spring.

6. The engine of claim 1, wherein the actuation mechanism comprises an electromechanical actuator operable independently of the engine shaft.

7. The engine of claim 1, wherein the actuation mechanism comprises at least one of a hydraulic actuator, a pneumatic actuator, or an electromagnetic actuator.

8. The engine of claim 1, wherein the actuation mechanism is controlled via electronic circuit or solenoid.

9. The engine of claim 1, wherein the guide apparatus comprises a bearing coupled to the piston lever, wherein the bearing is configured to engage and travel within a guide channel.

10. The engine of claim 9, wherein the guide channel is curved.

11. The engine of claim 1, further comprising an electronic engine control unit for operating the actuation device.

12. The engine of any of claim 1 further comprising a return mechanism configured to bias the piston lever against the actuation mechanism.

* * * * *